US009980627B1

(12) United States Patent
Lewis

(10) Patent No.: US 9,980,627 B1
(45) Date of Patent: May 29, 2018

(54) AUTOMATED SHOE POLISHING APPARATUS AND METHOD

(71) Applicant: Terence J. Lewis, North Brunswick, NJ (US)

(72) Inventor: Terence J. Lewis, North Brunswick, NJ (US)

( * ) Notice: Subject to any disclaimer, the term of this patent is extended or adjusted under 35 U.S.C. 154(b) by 0 days. days.

(21) Appl. No.: 15/723,663

(22) Filed: Oct. 3, 2017

(51) Int. Cl.
*A47L 23/02* (2006.01)

(52) U.S. Cl.
CPC ..... *A47L 23/02* (2013.01)

(58) Field of Classification Search
CPC ..... A47L 23/00; A47L 23/02
USPC ..... 15/30–37, 97.2
See application file for complete search history.

(56) References Cited

U.S. PATENT DOCUMENTS 920,884 A * 5/1909 Scheer ..... A47L 23/02 15/97.2
3,787,918 A * 1/1974 Ebert ..... A47L 23/02 15/31

FOREIGN PATENT DOCUMENTS

| | | | |
|---|---|---|---|
| DE | 3243062 | * | 5/1984 |
| JP | 5-317233 | * | 12/1993 |
| KR | 2002-0036826 | * | 5/2002 |
| WO | 85/02992 | * | 7/1985 |

* cited by examiner

*Primary Examiner* — Mark Spisich
(74) *Attorney, Agent, or Firm* — Dale J. Ream

(57) ABSTRACT

An automated shoe polishing apparatus for polishing a pair of shoes includes a drawer slidably received in an interior of a housing, a platform in the drawer having receiving areas for securing a pair of shoes to be polished. A dispenser assembly having a plurality of polish reservoirs is situated in the housing. A digital scanner situated in the housing is configured to make a 3D scan and determine the type of received shoes and the proper polishing technique. Under program control, an appropriate polish(es) is dispensed, sprayed on the shoes, and polishing and buffing brushes polish the pair of shoes, the process being reported on a digital display and speaker.

15 Claims, 18 Drawing Sheets

AUTOMATED SHOE POLISHING APPARATUS AND METHOD

BACKGROUND OF THE INVENTION

This application relates to shoe polishing devices and, more particularly, to a shoe polishing apparatus that is automated and has an electronic shoe recognition module.

Having one's shoes polished well can provide an added level of confidence to a man's attire. In fact, it has often been said, "You can tell a man's character from his shoes." In times past, seeing one or more "shoeshine boys" having a chair and a shoeshine box for shining the shoes of proper gentlemen was common. Today, this trade is less common but still available in travel and business locations. Further, in the modern era where wearing scuffed and unpolished shoes is commonplace, the art of polishing one's own shoes regularly is not often practiced or taught to the next generation. Therefore, a more convenient means for polishing one's shoes is needed.

A few automated shoe polishing devices have been proposed in the art for receiving a pair of shoes, say, into a box and applying shoe polish to them or buffing them to a shine.

Although presumably effective for their intended purposes, the proposed devices do not apply the technologies of digitally scanning the received shoes (such as with a laser mapping method), identifying the shoes and determining the appropriate characteristics and method for best treating them (including color or type of polish that is needed), and then dispensing the respective polish onto the shoes, and polishing the received shoes using the computer determined polishing material and method.

Therefore, it would be desirable to have an automated shoe polishing apparatus and method that satisfies these shortcomings in the prior art.

SUMMARY OF THE INVENTION

An automated shoe polishing apparatus for polishing a pair of shoes according to the present invention includes a drawer slidably received in an interior of a housing, a platform in the drawer having receiving areas for securing a pair of shoes to be polished. A dispenser assembly having a plurality of polish reservoirs is situated in the housing. A digital scanner situated in the housing is configured to make a 3D scan and determine the type of received shoes and the proper polishing technique. Under program control, an appropriate polish(es) is dispensed, sprayed on the shoes, and polishing and buffing brushes polish the pair of shoes, the process being reported on a digital display and speaker.

Therefore, a general object of this invention is to provide an automated shoe polishing apparatus that scans, images, and identifies the shoes received into the apparatus and then polishes and buffs them according to predetermined shoe data associated with the identified shoe.

Another object of this invention is to provide an automated shoe polishing apparatus, as aforesaid, that includes a polishing assembly having rollers that operate, under program control, to circle and polish a shoe received into a housing.

Still another object of this invention is to provide an automated shoe polishing apparatus, as aforesaid, that includes a buffing assembly having one or more brushes that operate, under program control, to circle and buff a shoe received into the housing.

Yet another object of this invention is to provide an automated shoe polishing apparatus, as aforesaid, having a touch screen display for receiving user control input and displaying operational data.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
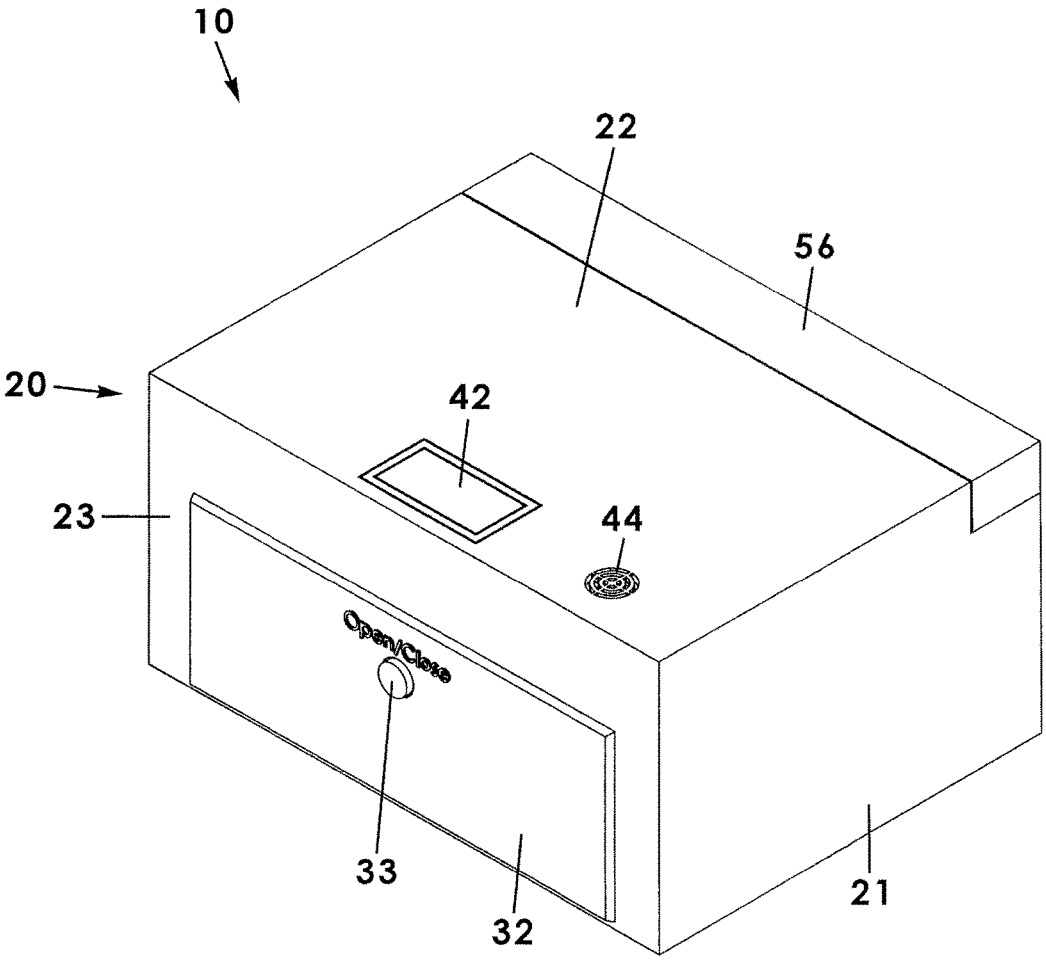
FIG. 1 is a perspective view of an automated shoe polishing apparatus according to a preferred embodiment of the present invention illustrated with a drawer and reservoir compartment in a closed configuration.

An automated shoe polishing apparatus and method according to a preferred embodiment of the present invention will now be described in detail with reference to FIGS. 1 to 12*b* of the accompanying drawings. The automated shoe polishing apparatus 10 includes a housing 20, a dispenser assembly 50, a polishing assembly 60, a buffing assembly 70, and a 3D digital scanner 45.

The housing 20 includes a plurality of walls that together define an interior area and includes a drawer 30 slidably movable into or out of the interior area. More particularly, the housing 20 may include a bottom wall, side walls 21 extending upwardly from respective peripheral edges, and a top wall 22 coupled to upper edges of the upstanding side walls. In an exemplary embodiment and as shown in the accompanying drawings, each face of the housing 20 may have a generally rectangular configuration although other configurations would also work.

Figure 2:
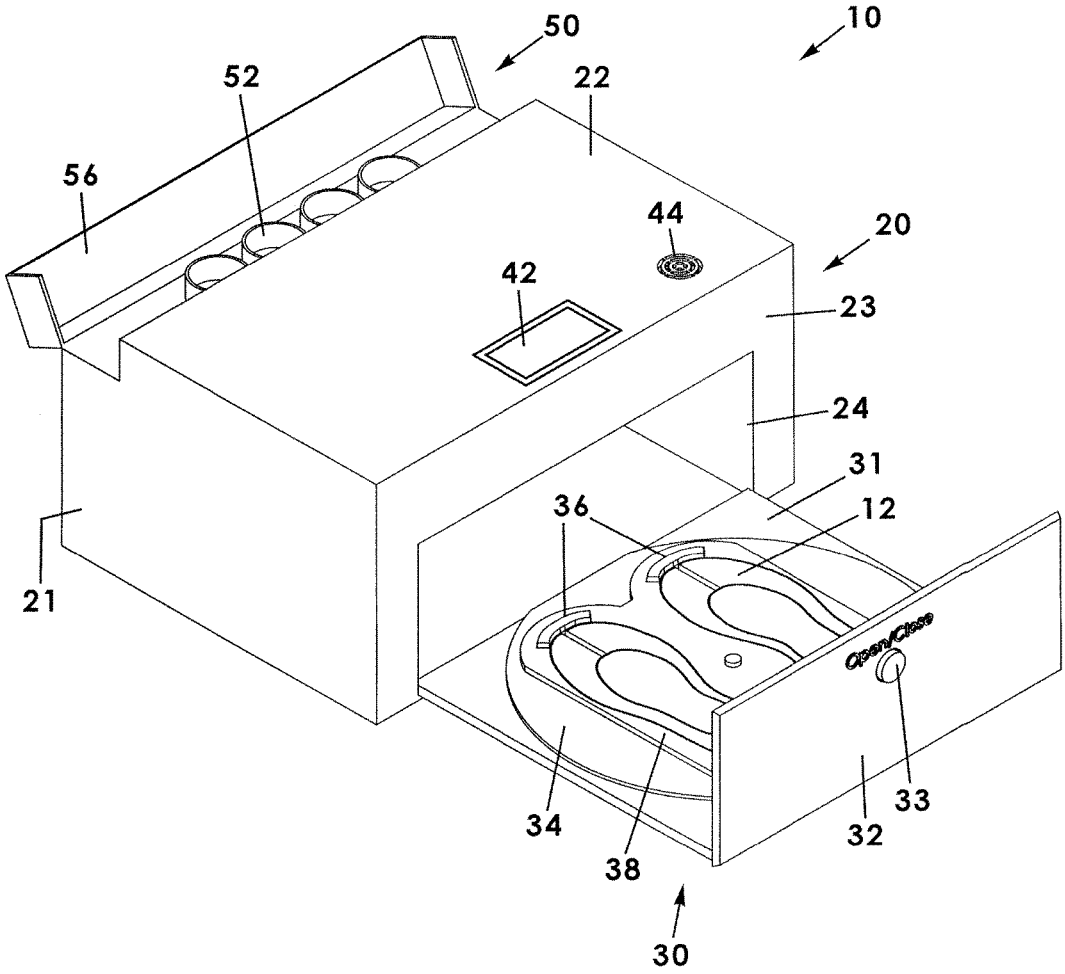
FIG. 2 is a perspective view of an automated shoe polishing apparatus as in FIG. 1 illustrated with the drawer and reservoir compartment in an open configuration.
Figure 3:
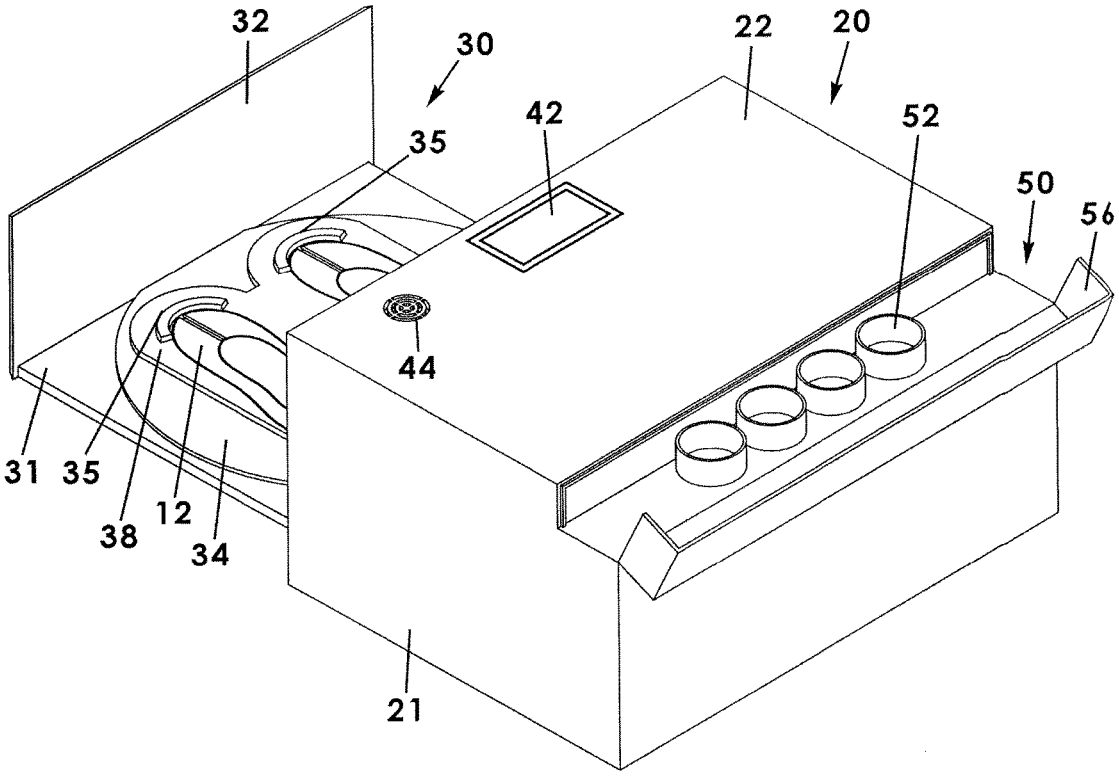
FIG. 3 is a perspective view from a reverse angle of the shoe polishing apparatus as in FIG. 2.
Figure 4A:
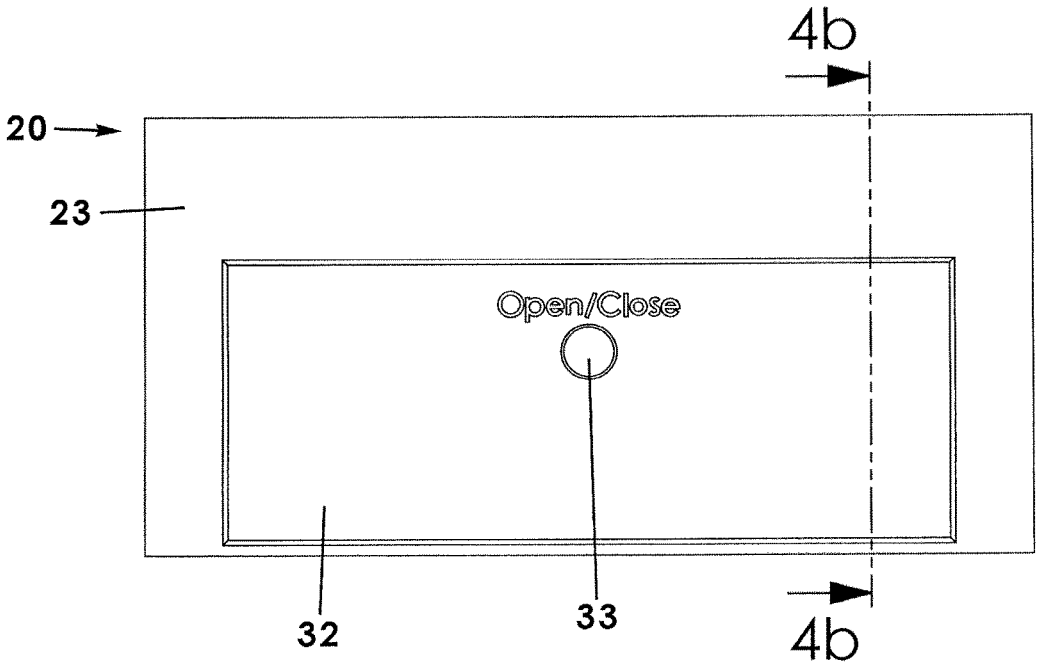
FIG. 4*a* is a front view of the housing of the apparatus as in FIG. 1.
Figure 4B:
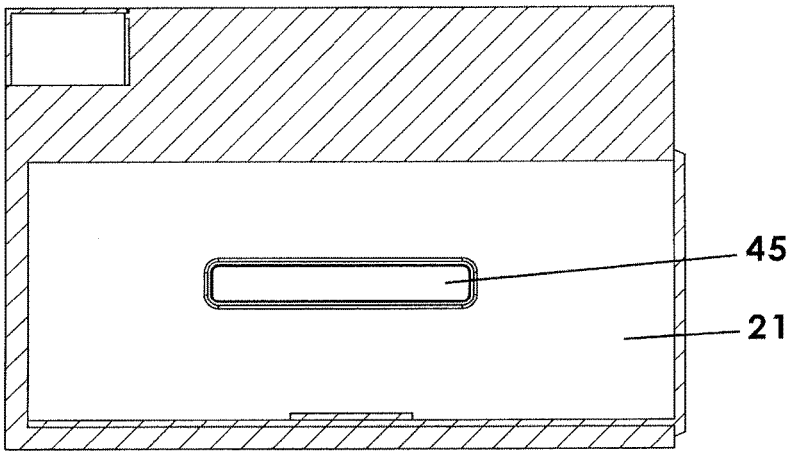
FIG. 4*b* is a sectional view taken along line 4*b*-4*b* of FIG. 4*a;*
Figure 5A:
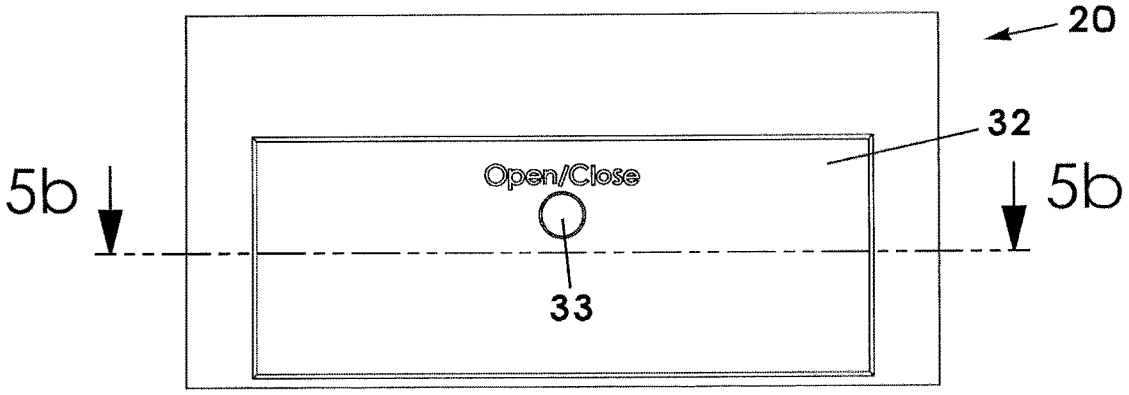
FIG. 5*a* is another front view of the housing of the apparatus of FIG. 1.
Figure 5B:
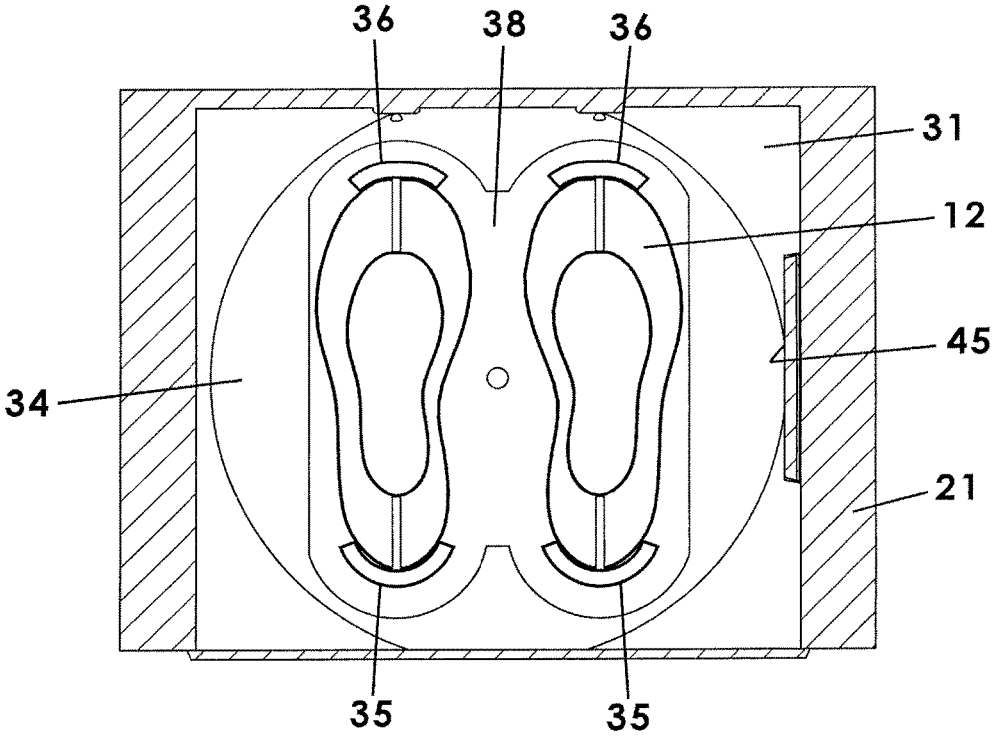
FIG. 5*b* is a sectional view taken along line 5*b*-5*b* of FIG. 5*a* illustrated with the receiving platform at one rotated position.
Figure 5C:
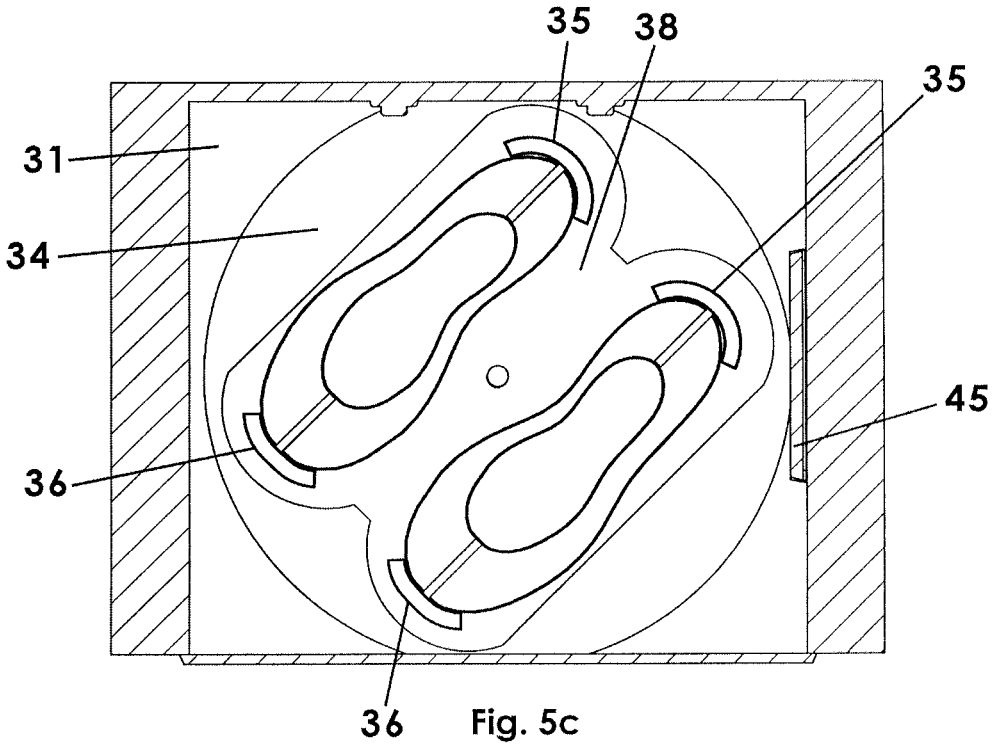
FIG. 5*c* is another sectional view taken along line 5*b*-5*b* of FIG. 5*a* illustrated with the receiving platform at another rotated position.
Figure 5D:
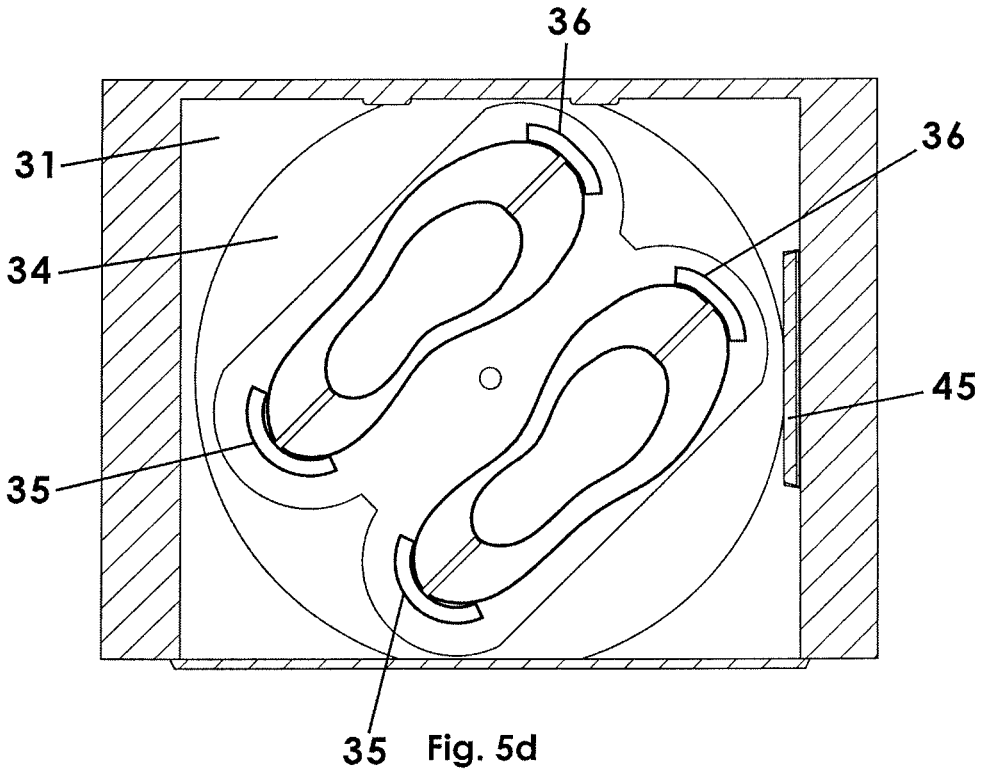
FIG. 5*d* is another sectional view taken along line 5*b*-5*b* of FIG. 5*a* illustrated with the receiving platform at one position.

The plurality of walls includes a front wall 23 defining an opening 24 through which a drawer 30 is slidably movable between a closed configuration situated inside the interior area (FIG. 1) and an open configuration substantially extending frontwardly outside of the interior area (FIG. 2). The drawer 30 includes at least a bottom panel 31 and a front panel 32 extending upwardly from a front peripheral edge of the bottom panel 31. In an exemplary embodiment, the drawer 30 may be opened by pressing an open/close button 33 in electrical connection to a motor (not shown) in the manner of a compact disc or digital video disc player although a manually operable drawer would also work.

The drawer 30 may include a receiving platform 34 rotatably coupled to the bottom panel 31 of the drawer 30. The receiving platform 34 may be electrically connected to a motor (not shown) and controls for rotating the receiving platform 34 relative to the bottom panel 31. The receiving platform 34 may include a single or a pair of receiving areas 38 for selectively receiving the pair of shoes 12 to be polished (FIG. 2). Each receiving area 38 may include indicia in the form of a shoe so that a user or attendant is shown exactly where and in what orientation to position the shoes for polishing. In addition, one or more guide members may be mounted to the bottom panel 31 proximate respective receiving areas 38 for securing the pair of shoes 12 in a predetermined location. More particularly, a heel guide member 35 and a toe guide member 36 may be positioned opposite one another, i.e. at ends of a shoe outline, so as to secure the shoes therein. In an embodiment, the guide members may be length adjustable so that the receiving area may hold shoes of any size securely atop the receiving platform 34.

The automated shoe polishing apparatus 10 may include control electronics (FIG. 12*a*) such as a processor 40 capable of executing programming instructions stored in a non-volatile memory 41 and processing data stored in data structures defined by the memory 41. The electronics may be situated in an electronics box (not shown) situated inside or outside of the housing 20. Further, a digital display 42 in data communication with the processor 40 may be situated on an outer surface of a respective wall of the housing 20. In an exemplary embodiment, the display 42 may be positioned on a top wall of the housing 20 and include both an output device to display instructions and status information and an input device that enables a user to select available services. Specifically, the display 42 may be a touch screen input/output device. Still further, the electronics of the present invention may include a speaker 44 in data communication with the processor 40 and mounted to the housing 20, the speaker being configured to broadcast instructions, status information, or other sound data stored in memory 41. A power source, such as a battery 43, may be included in the electronics box and electrically connected to the electronics discussed above as well as to the various motors and brushes discussed below.

The automated shoe polishing apparatus 10 may include a digital scanner 45 configured for 3D laser scanning of the pair of shoes 12 received upon the receiving area 38 on the bottom panel 31 of the drawer 30. The scanner 45 may be mounted to an inner surface of a wall of the housing 20 (FIG. 6*b*) and be in data communication with the processor 40.

The automated shoe polishing apparatus 10 may include a dispenser assembly 50 coupled to the housing 20. The dispenser assembly 50 includes a plurality of reservoirs 52 configured to store shoe polishing products, respectively. Each reservoir 52 may include a valve configured to dispense a predetermined quantity of a polishing product which may then be sprayed onto the pair of shoes 12 as will be described below. The reservoirs 52 may be situated in a dispenser compartment 54 defined by the housing 20. In an exemplary embodiment, the dispenser compartment 54 is positioned near the back of the housing 20 and defines an interior space dimensioned to receive the reservoirs therein. A dispenser access door 56 is pivotally movable between an open configuration allowing access to respective reservoirs 52 and a closed configuration not allowing access to the reservoirs 52.

Figure 6A:
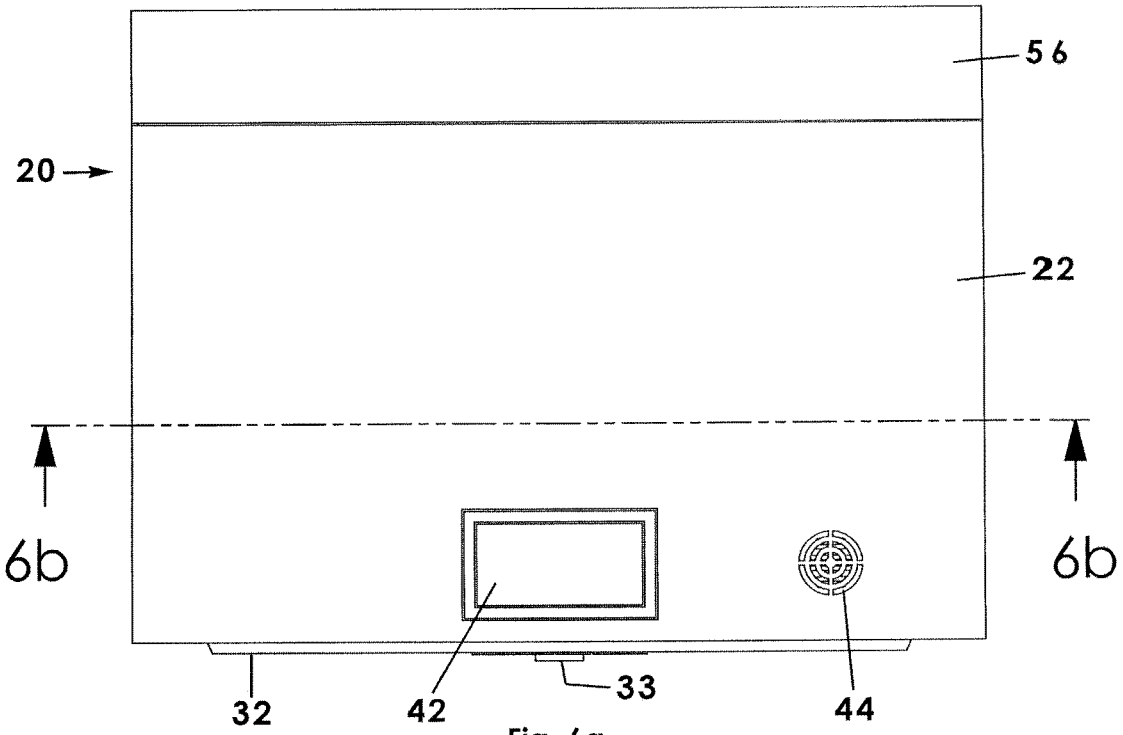
FIG. 6*a* is a top view of the housing of the apparatus as in FIG. 1.
Figure 6B:
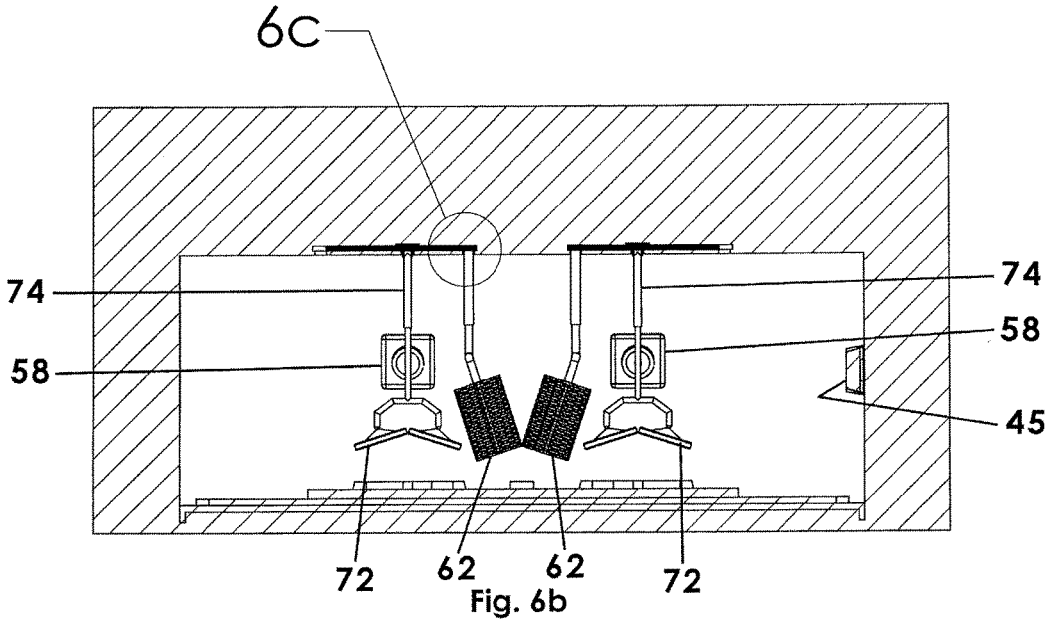
FIG. 6*b* is a sectional view taken along line 6*b*-6*b* of FIG. 6*a;*
Figure 6C:
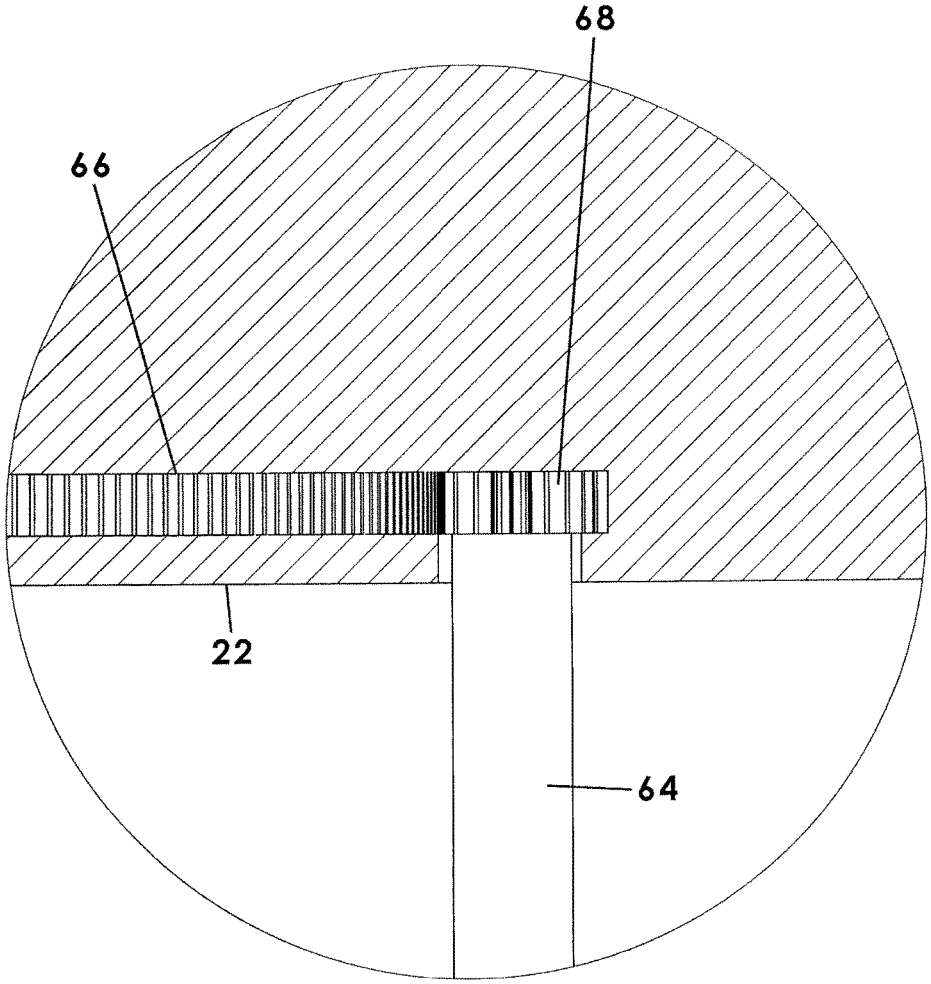
FIG. 6*c* is an isolated view on an enlarged scale taken from FIG. 6*b;*
Figure 7A:
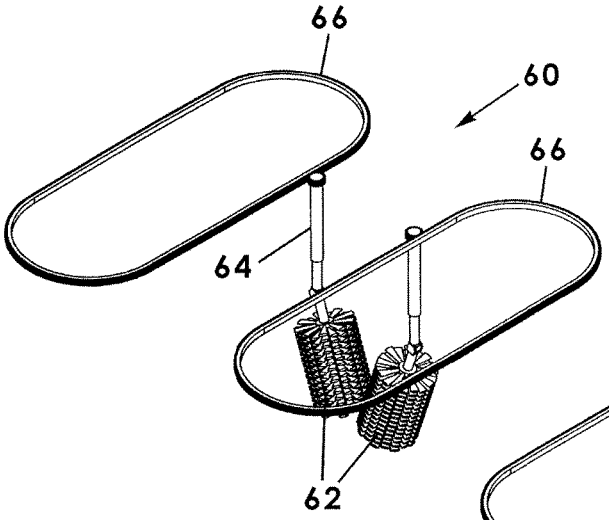
FIGS. 7*a* to 7*d* illustrate the polishing assembly in various articulations and positions relative to a track assembly.
Figure 7B:
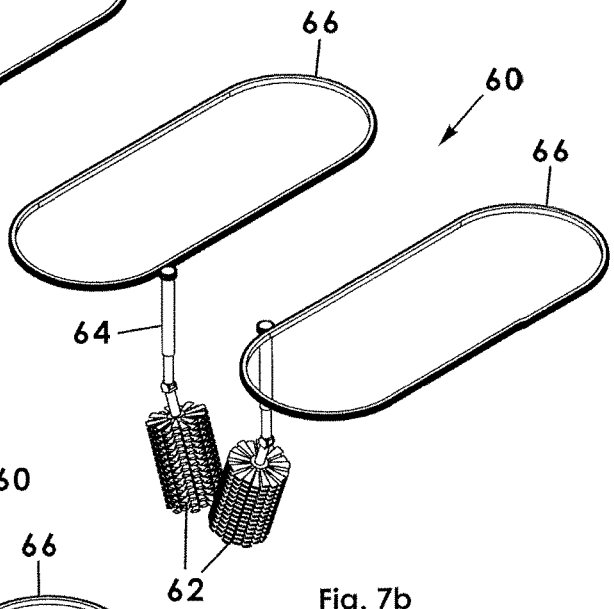
Figure 7C:
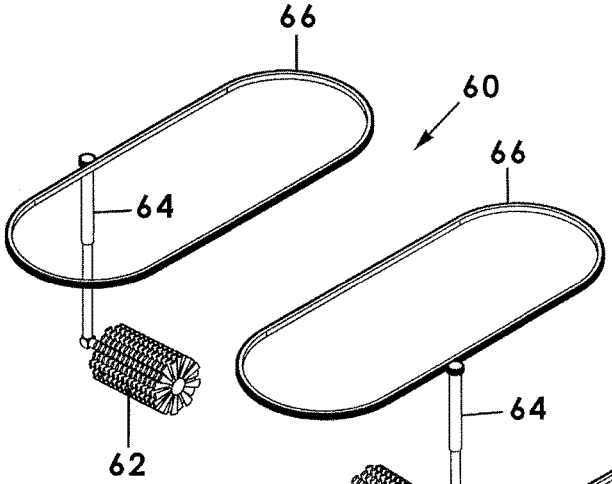
Figure 7D:
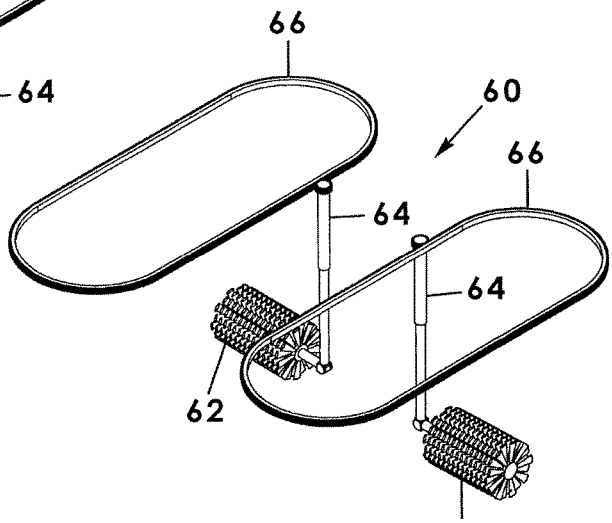
Figure 8A:
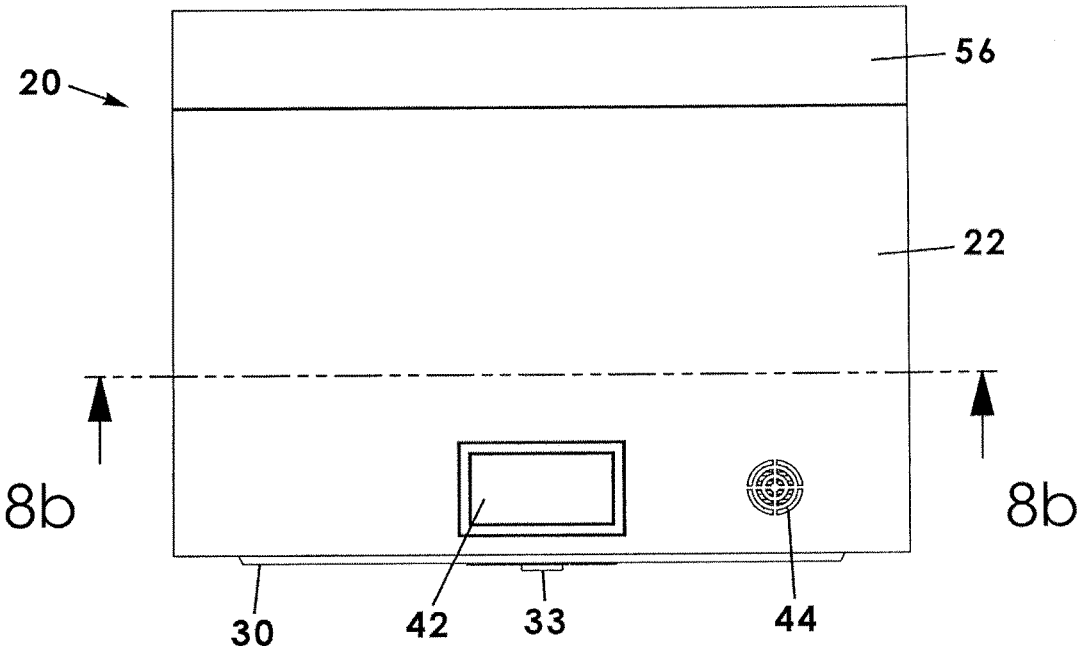
FIG. 8*a* is another top view of the housing of the apparatus as in FIG. 1.
Figure 8B:
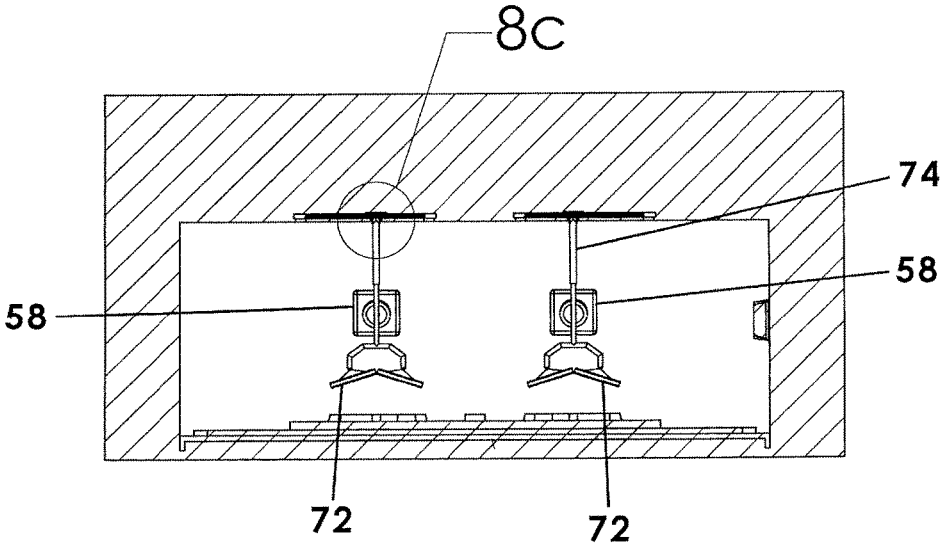
FIG. 8*b* is a sectional view taken along line 8*b*-8*b* of FIG. 8*a;*
Figure 8C:
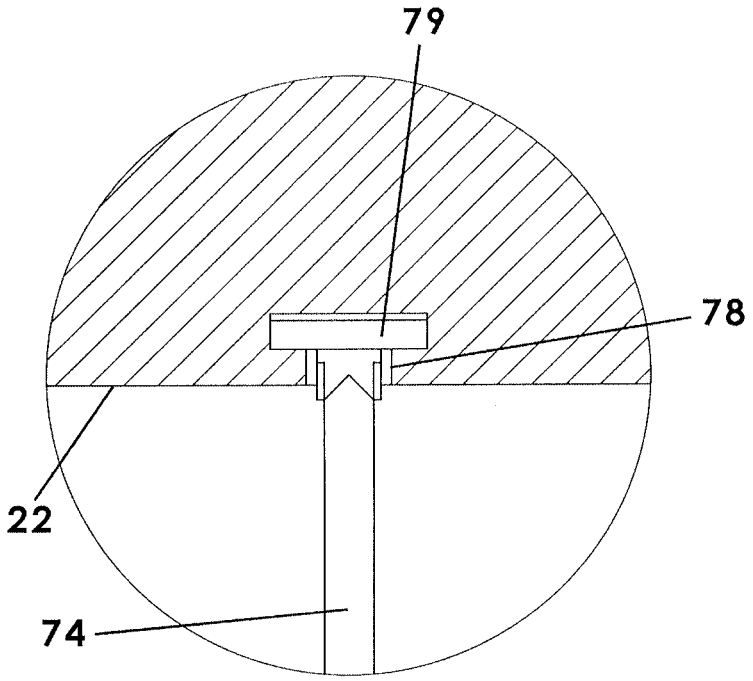
FIG. 8*c* is an isolated view on an enlarged scale taken from FIG. 8*b;*
Figure 9A:
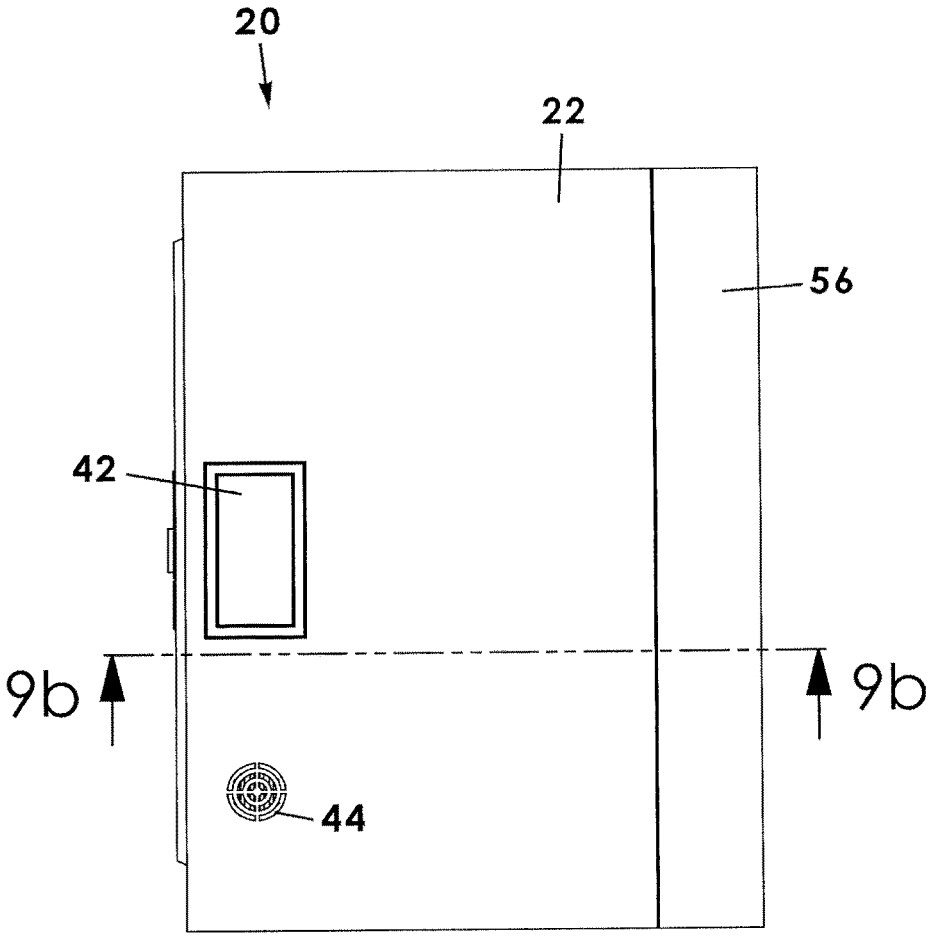
FIG. 9*a* is another top view of the housing of the apparatus as in FIG. 1.
Figure 9B:
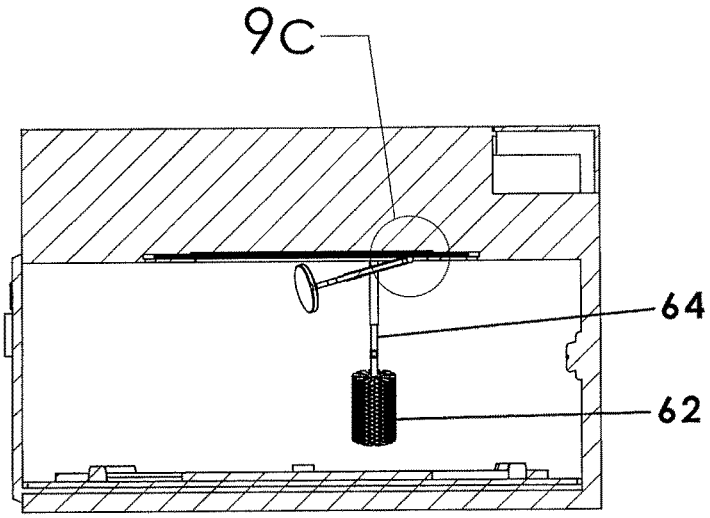
FIG. 9*b* is a sectional view taken along line 9*b*-9*b* of FIG. 9*a;*
Figure 9C:
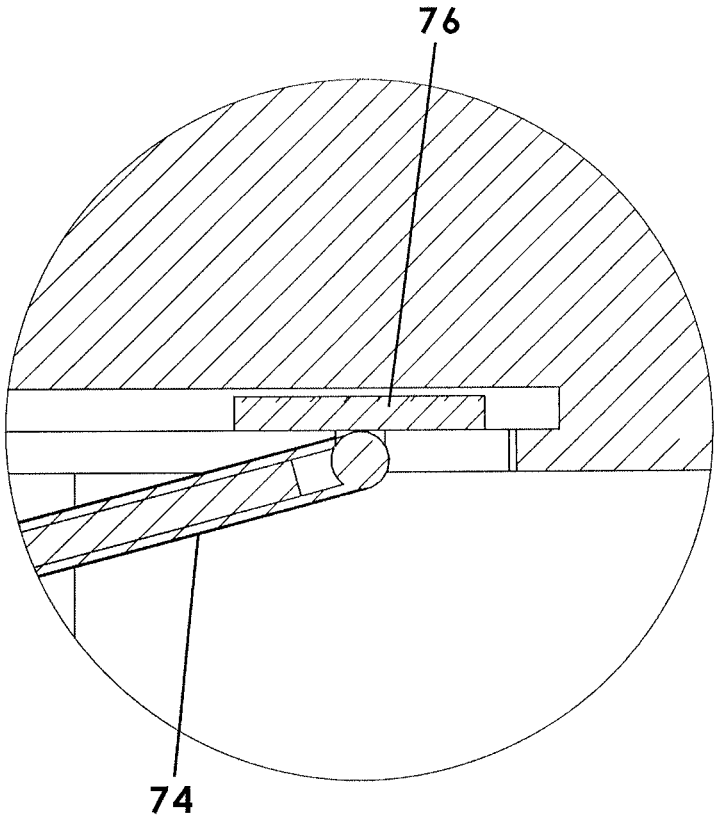
FIG. 9*c* is an isolated view on an enlarged scale taken from FIG. 9*b;*
Figure 10A:
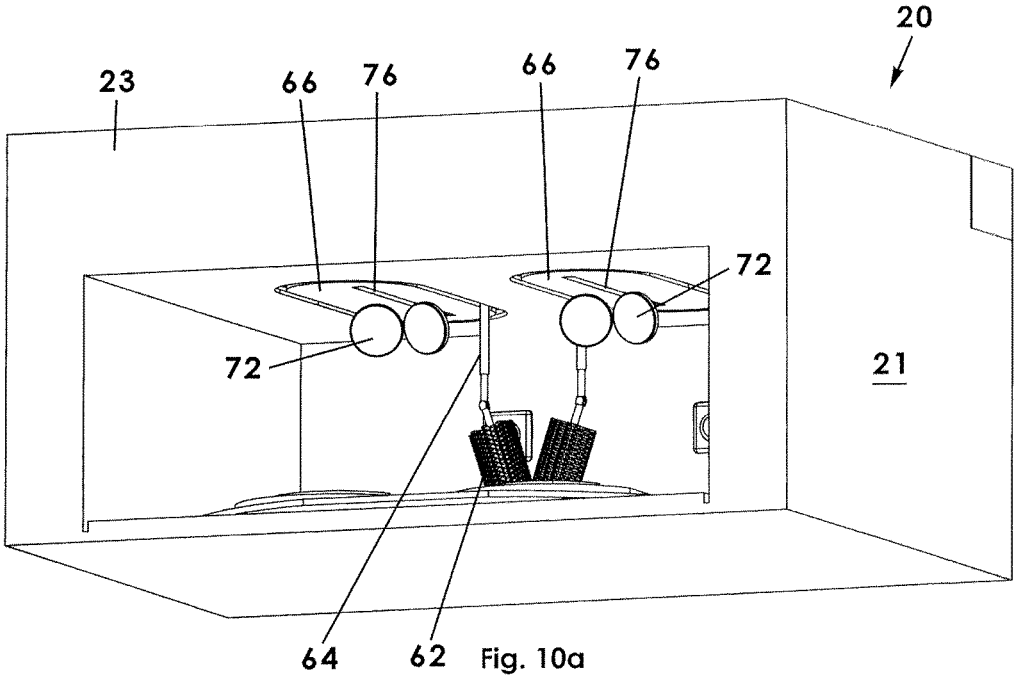
FIG. 10*a* is a perspective view of the housing as in FIG. 1 taken from a lower angle and illustrated with the drawer removed for the sake of clarity and with the buffing assembly in a stowed configuration.
Figure 10B:
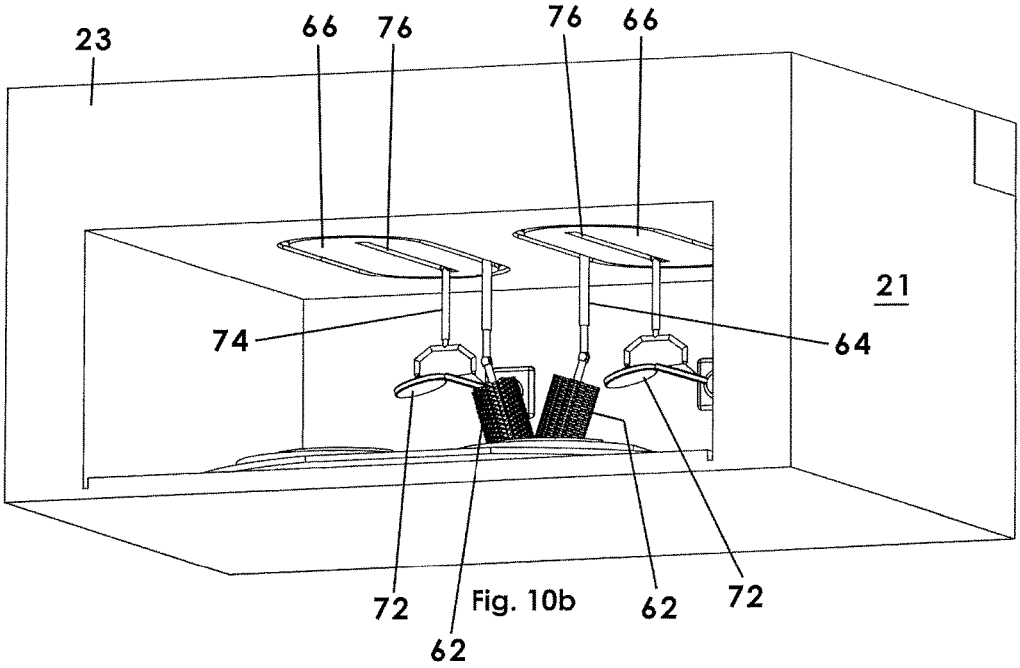
FIG. 10*b* is a perspective view of the housing as in FIG. 10*a* illustrated with the buffing assembly in a deployed configuration.
Figure 10C:
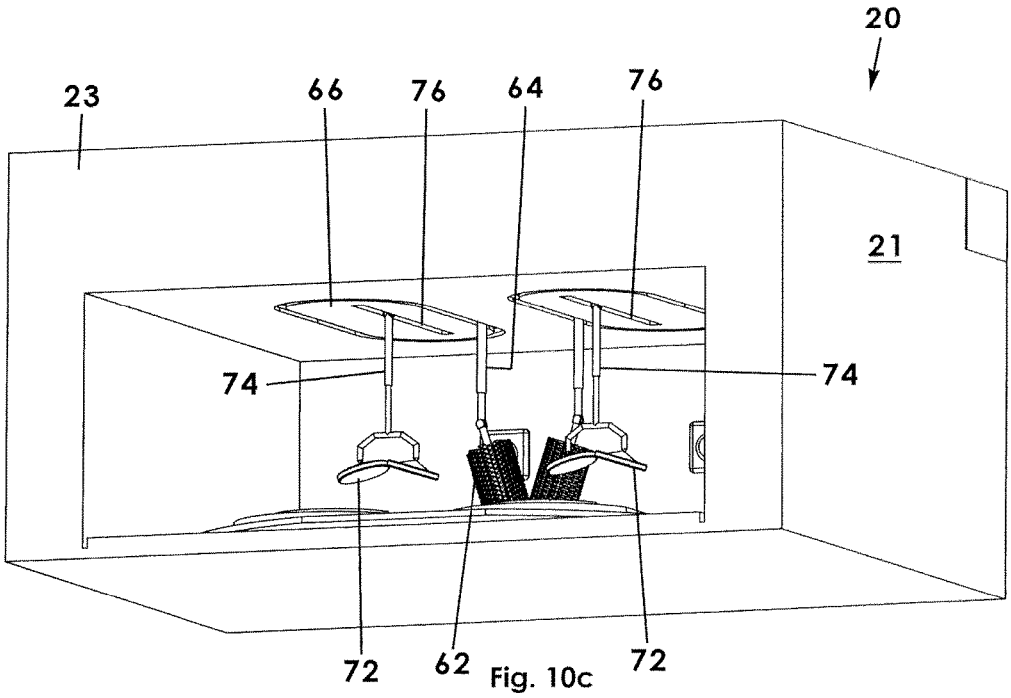
FIG. 10*c* is a perspective view of the housing as in FIG. 10*b* illustrated with the buffing assembly in a partially deployed configuration.
Figure 10D:
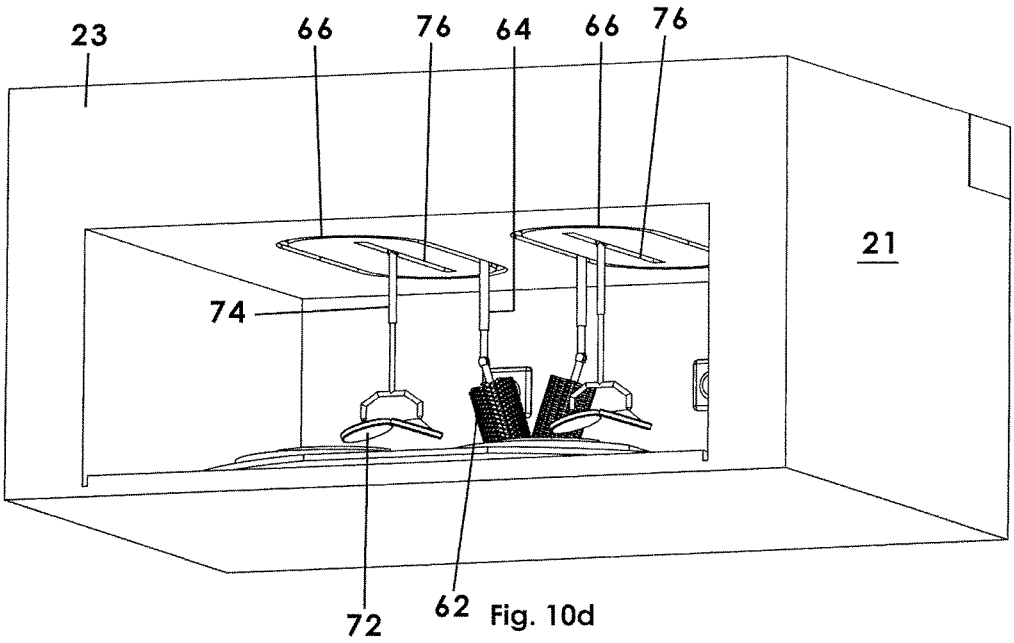
FIG. 10*d* is a perspective view of the housing as in FIG. 10*a* illustrated with the buffing assembly in a fully deployed configuration.
Figure 11:
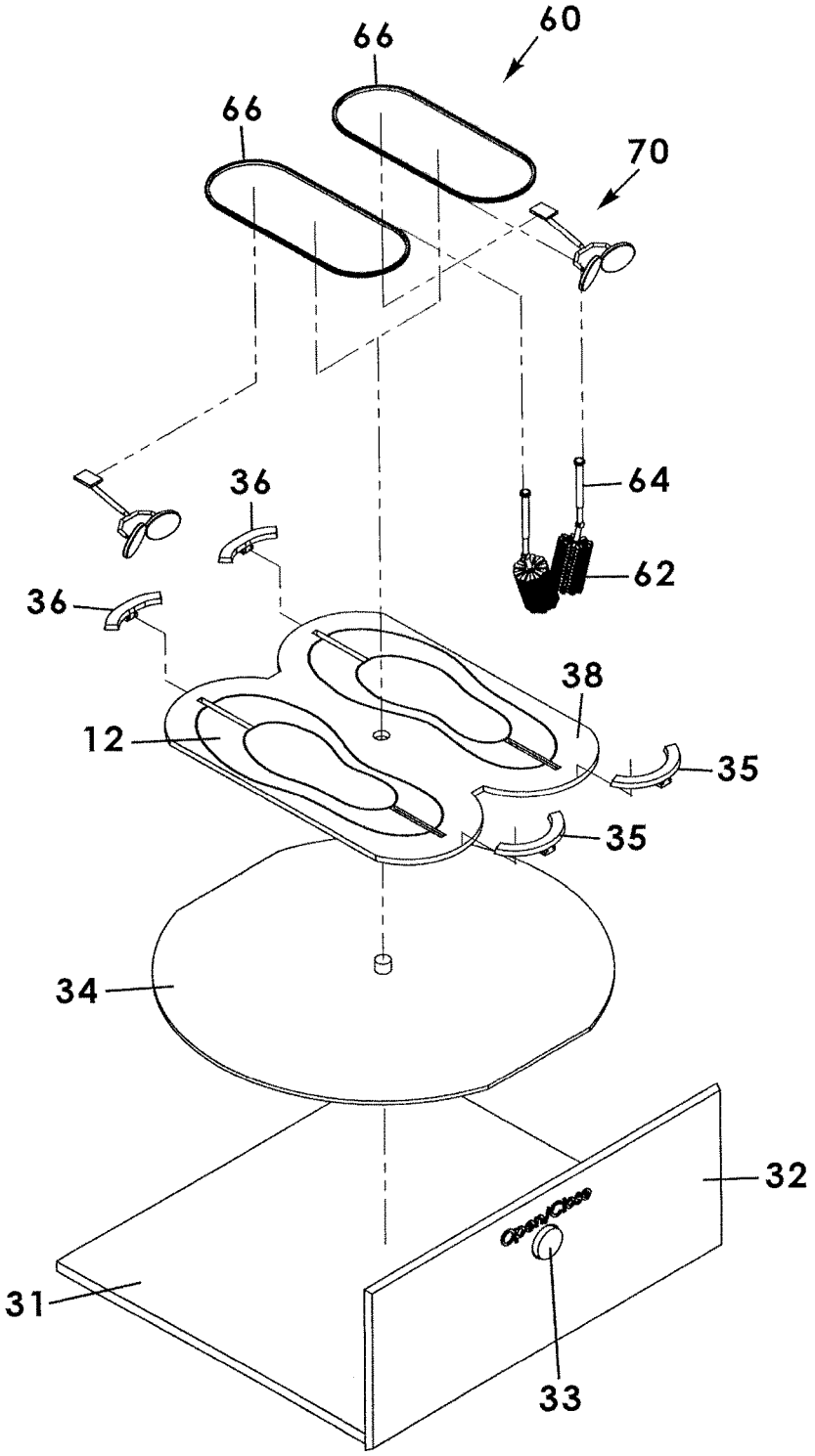
FIG. 11 is an exploded view of the shoe polishing apparatus as in FIG. 1 with the housing removed.

A sprayer 58 is situated in the interior area of the housing 20 and in fluid communication with the valve of each reservoir 52 (FIG. 6*b*). When actuated, the sprayer 58 is configured to spray a selected polishing product onto the pair of shoes 12 positioned on the receiving platform 34. The sprayer 58 may be electrically connected to the processor 40 which is configured to selectively actuate or energize the sprayer 58 as will be described later.

The automated shoe polishing apparatus 10 includes a polishing assembly 60 also mounted in the interior area of the housing 20 and configured to polish the pair of shoes 12 on the receiving platform 34 once the polishing product has been applied thereto as described above, the polishing assembly 60 being in data communication with processor 40 and controlled thereby. More particularly, the polishing assembly 60 includes at least one polishing brush 62 (and, preferably a pair of polishing brushes) that, when actuated, is proximate the pair of shoes 12 and operable to bear against the shoes in a rotational manner that, after a polish product is dispensed and sprayed, polishes the shoes. In an embodiment, the rotatable brush is in fluid communication with the dispenser assembly 50 for receiving a respective dispensed polishing product thereon.

More particularly, each polishing brush 62 may be coupled to a respective polisher arm 64 that is selectively movable in the interior area of the housing 20 between a stowed configuration in which the polishing brush 62 is displaced from the pair of shoes 12 on the receiving platform 34 and a deployed configuration in which the polishing brush 62 is in operable contact with the pair of shoes, whereby to polish said shoes when energized. In the exemplary embodiment, the polisher arm 64 may include a proximal end coupled to the top wall of the housing 20 and extend downward to a distal end coupled to the polishing brush 62 although the polisher arm 64 may extend from another wall of the housing 20 or even extend upwardly from the bottom panel 31 of the drawer 30 in other embodiments. Each polisher arm 64 may have a length adjustable construction, i.e. may be telescopic.

Furthermore, the polishing assembly 60 may include a track assembly 66 positioned in the interior area of the housing 20, such as proximate or coupled to the top wall in the exemplary embodiment shown in the drawings. Further, the polishing assembly 60 includes a drive motor 68 operatively coupled to the track assembly 66 and in data communication with the processor 40. Accordingly, the drive motor 68 is configured to travel along the track assembly 66 when energized, i.e. actuated, by the processor 40. It is understood that the polishing brush 62 may also be energized to rotate when the drive motor 68 is energized, the polishing brush 62 polishing respective shoes when positioned to bear against them.

In the exemplary embodiment, the track assembly 66 is a continuous track defining a plurality of gear teeth. The drive motor 68 may be a drive gear having teeth complementary to the gear teeth of the continuous track and be engaged therewith. Accordingly, the drive gear is moved around the continuous track when energized.

In another aspect, the automated shoe polishing apparatus 10 includes a buffing assembly 70 mounted in the interior area of the housing 20 proximate the polishing assembly 60. The buffing assembly 70 includes at least one brush 72, the brush 72 being selectively energized to rotate. The buffing assembly 70 may also include a buffing arm 74 pivotally coupled to a wall of the housing 20 and movable between a stowed configuration in which the associated brush is displaced from the pair of shoes 12 secured upon the receiving platform 34 and a deployed configuration in which the brush 72 bears against the pair of shoes 12. The buffing arm 74 and associated brush 72 may be in electrical communication with the processor 40 and be operable under program control.

The buffing assembly 70 may include a buffing drive track 76 having a linear configuration that is situated in a channel 78 defined by a respected wall of the housing 20 (FIG. 6*b*). The buffing assembly 70 includes a buffer brush drive motor 79 that is configured to travel along the buffing drive track 76 when energized and directed by the processor 40. It is understood that the buffing drive track 76 and associated drive motor 79 may include complimentary gear teeth.

Figure 12A:
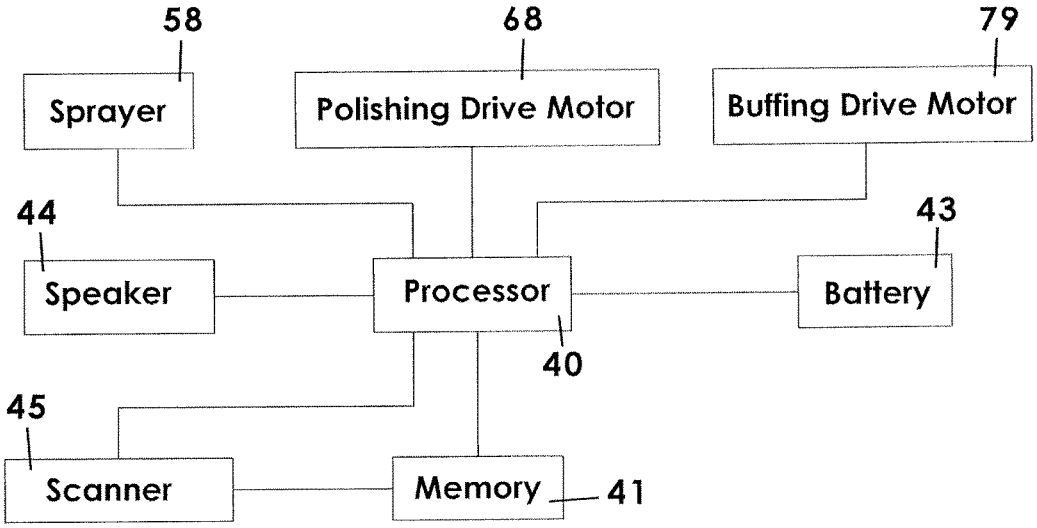
FIG. 12*a* is a block diagram of the electronic and electrically energized components of the present invention.
Figure 12B:
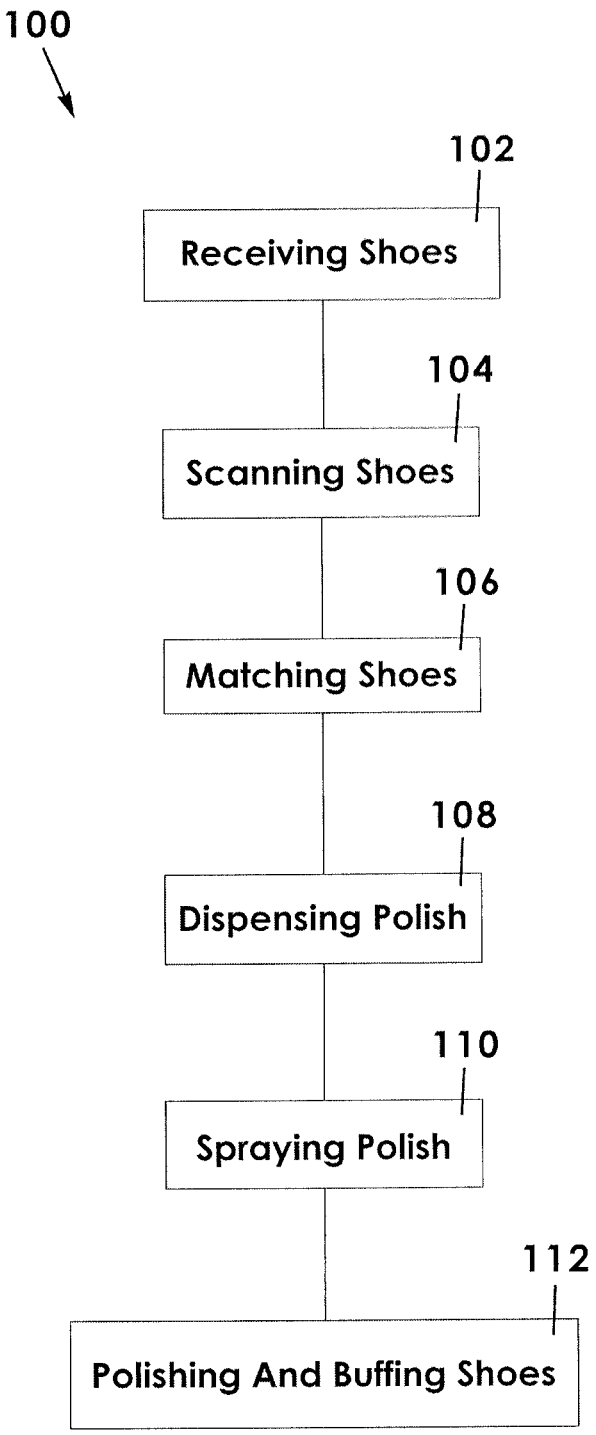
FIG. 12*b* is a flowchart illustrating the methodology of polishing shoes with the apparatus of the present invention.

In use, an exemplary methodology 100 illustrating operation of the automated shoe polishing apparatus 10 is illustrated in FIG. 12*b* and explained below. It is understood that the method disclosed herein includes programming instructions causing the processor 40 to energize opening/closing of the drawer 30, operation of the scanner 45, dispensing a polishing product, energizing the sprayer 58, operating the polishing assembly 60 and buffing assembly 70, as well as performing other operations. More particularly, the method 100 begins at step 102 with receiving a pair of shoes 12 onto the receiving platform 34 of the drawer 30 of the housing 20. Once the shoes are secured therein as described above, the shoes may be scanned by the 3D laser scanner at step 104. Then, the scanned shoe data may be compared with predetermined images or parameters stored in memory 41 at step 106 in an effort to match the scanned shoes with the same or similar shoe data which will then direct the processes of dispensing polish and shining the shoes. Accordingly, the method 100 continues to step 108 where the processor 40 directs dispenser assembly 50 to dispense a respective shoe polishing product and then, at step 110, to spray the selected polish product onto the shoes. Finally, at step 112, the polishing assembly 60 and buffing assembly 70 may be energized to shine the shoes as described above. Instructions may be given by a user using the touch screen display 42 and status information may be given via the display 42 and the speaker 44.

It is understood that while certain forms of this invention have been illustrated and described, it is not limited thereto except insofar as such limitations are included in the following claims and allowable functional equivalents thereof.

The invention claimed is:

1. An automated shoe polishing apparatus for polishing a pair of shoes, comprising:

a housing having a plurality of walls defining an interior area;

a drawer slidably received in said interior area and selectively movable between an open configuration extending outwardly of said interior area and a closed configuration situated inside said interior area;

a receiving platform rotatably mounted in said drawer and having a pair of receiving areas selectively receiving the pair of shoes;

a dispenser assembly coupled to said housing that includes a plurality of reservoirs for holding a plurality of shoe polish products, respectively, each reservoir having a valve that dispenses a respective shoe polish product contained therein when actuated;

a sprayer situated in said interior area of said housing and in fluid communication with said plurality of reservoirs, said sprayer configured to spray a quantity of the respective shoe polish product dispensed by a respective reservoir;

a polishing assembly mounted in said interior area of said housing having at least one brush selectively movable between a stowed configuration displaced from the pair of shoes and a deployed configuration bearing against the pair of shoes;

a digital scanner situated in said interior area that is configured to scan the pair of shoes and generate scanned shoe data;

a power source;

a processor in electrical communication with said power source and in data communication with said digital scanner for receiving said scanned shoe data and in electrical communication with said dispenser assembly;

a non-volatile memory in data communication with said processor, said memory having data structures for storing programming and predetermined shoe data;

programming in said memory that, when executed by said processor, causes said processor to match said scanned shoe data with said predetermined shoe data and to generate matched shoe data; and programming in said memory that, when executed by said processor, causes said processor to actuate said dispenser assembly to dispense said respective shoe polish product according to said matched shoe data.

2. The automated shoe polishing apparatus as in claim 1, wherein:

said receiving platform is rotatably mounted to a receiving motor that is situated in said drawer and in electrical communication with said processor;

programming in said memory that, when executed by said processor, causes said processor to actuate said receiving motor so as to rotate said receiving platform.

3. The automated shoe polishing apparatus as in claim 1, wherein said receiving platform includes a toe guide member and a heel guide member attached to opposed ends of said pair of receiving areas, said toe guide member and said heel guide member, together, securing the pair of shoes at a predetermined location atop said receiving platform.

4. The automated shoe polishing apparatus as in claim 1, further comprising a display situated on an outer surface of a respective wall of said housing and in data communication with said processor, said display including an input device and an output device.

5. The automated shoe polishing apparatus as in claim 4, wherein said input device and said output device are a touch screen module.

6. The automated shoe polishing apparatus as in claim 1, wherein:

said housing includes a dispenser compartment defining an interior space and a dispenser access door movable between an open configuration allowing access to said dispenser compartment and a closed configuration not allowing access to said interior space;

said dispenser assembly is situated in said dispenser compartment.

7. The automated shoe polishing apparatus as in claim 1, further comprising:

a speaker situated on an outer surface of a respective wall of said housing and in data communication with said processor;

programming in said memory that, when executed by said processor, causes said processor to actuate said speaker to announce one of operational instructions or a narration of current operations.

8. The automated shoe polishing apparatus as in claim 1, wherein said polishing assembly includes:

a track assembly situated in said interior area of said housing;

a drive motor operatively engaged with said track assembly and in data communication with said processor, said drive motor configured to travel about said track assembly when actuated;

wherein said polishing assembly is electrically connected to said drive motor and said at least one brush is rotated when actuated.

9. The automated shoe polishing apparatus as in claim 8, wherein:

said track assembly is a continuous track having one of an oval, circular, or rectangle configuration;

said continuous track includes a plurality of gear teeth;

said drive motor includes a drive gear that is engaged with said plurality of gear teeth and moved about said continuous track when said drive motor is energized.

10. The automated shoe polishing apparatus as in claim 9, wherein said polishing assembly includes:

an arm having a first end pivotally coupled to a respective wall of said housing and a second end pivotally coupled to said at least one brush, said arm being length adjustable;

wherein said arm is in data communication with said processor;

programming in said memory that, when executed by said processor, causes said processor to actuate said arm to move between said stowed configuration and said deployed configuration;

programming in said memory that, when executed by said processor, causes said processor to actuate said second end and said at least one brush to pivot in relation to said arm.

11. The automated shoe polishing apparatus as in claim 10, further comprising:

a buffing assembly mounted in said interior area of said housing having at least one brush, said at least one brush being selectively movable between a stowed configuration displaced from the pair of shoes and a deployed configuration bearing against the pair of shoes;

wherein said buffing assembly includes:

a buffing drive track having a linear configuration and situated in a channel defined by a respective wall of said housing;

a buffer brush drive motor configured to travel along said buffing drive track when actuated;

a buffing arm having a first end coupled to said buffer brush drive motor and a second end pivotally coupled to said at least one brush of said buffing assembly, said buffing arm being length adjustable;

wherein said buffing arm is in data communication with said processor;

programming in said memory that, when executed by said processor, causes said processor to actuate said buffing arm to move said at least one brush of said buffing assembly between said stowed configuration and said deployed configuration.

12. The automated shoe polishing apparatus as in claim 8, wherein said polishing assembly includes:

an arm having a first end pivotally coupled to a respective wall of said housing and a second end pivotally coupled to said at least one brush, said arm being length adjustable;

wherein said arm is in data communication with said processor;

programming in said memory that, when executed by said processor, causes said processor to actuate said arm to move between said stowed configuration and said deployed configuration;

programming in said memory that, when executed by said processor, causes said processor to actuate said second end and said at least one brush to pivot in relation to said arm.

13. The automated shoe polishing apparatus as in claim 1, further comprising a buffing assembly mounted in said interior area of said housing having at least one brush, said at least one brush being selectively movable between a stowed configuration displaced from the pair of shoes and a deployed configuration bearing against the pair of shoes.

14. The automated shoe polishing apparatus as in claim 13, wherein said buffing assembly includes:

a buffing drive track having a linear configuration and situated in a channel defined by a respective wall of said housing;

a buffer brush drive motor configured to travel along said buffing drive track when actuated;

a buffing arm having a first end coupled to said buffer brush drive motor and a second end pivotally coupled to said at least one brush of said buffing assembly, said buffing arm being length adjustable;

wherein said buffing arm is in data communication with said processor;

programming in said memory that, when executed by said processor, causes said processor to actuate said buffing arm to move said at least one brush of said buffing assembly between said stowed configuration and said deployed configuration.

15. The automated shoe polishing apparatus as in claim 1, wherein said digital scanner is configured for 3D laser object scanning.

* * * * *